US005897411A

United States Patent [19]

Stark et al.

[11] Patent Number: 5,897,411

[45] Date of Patent: Apr. 27, 1999

[54] REPULPABLE MOISTURE VAPOR BARRIER

[75] Inventors: David E. Stark, Chapel Hill; Charles D. Rowe, Raleigh, both of N.C.

[73] Assignee: Reichhold Chemicals, Inc., Durham, N.C.

[21] Appl. No.: 08/941,693

[22] Filed: Oct. 1, 1997

[51] Int. Cl.[6] ..... B32B 29/00; B32B 23/08

[52] U.S. Cl. ..... 428/511; 428/211; 428/324; 428/537.5

[58] Field of Search ..... 428/195, 211, 428/537.5, 324, 511; 442/79, 85

[56] References Cited

U.S. PATENT DOCUMENTS

| | | | |
|---|---|---|---|
| 3,505,156 | 4/1970 | Handscomb et al. | 161/67 |
| 3,632,424 | 1/1972 | Graham et al. | 117/155 |
| 3,804,653 | 4/1974 | Morris et al. | 106/124 |
| 4,265,977 | 5/1981 | Kawamura et al. | 428/511 |
| 4,301,210 | 11/1981 | Yasuda et al. | 428/342 |
| 4,381,365 | 4/1983 | Mishiba et al. | 524/460 |
| 4,673,616 | 6/1987 | Goodwin | 428/289 |
| 4,689,256 | 8/1987 | Slosberg et al. | 482/95 |
| 5,093,449 | 3/1992 | Durney Cronin et al. | 526/318 |
| 5,169,715 | 12/1992 | Maubert et al. | 428/331 |
| 5,434,215 | 7/1995 | Sankaran et al. | 524/763 |
| 5,441,999 | 8/1995 | Jarvis et al. | 524/271 |
| 5,635,279 | 6/1997 | Ma et al. | 428/174 |
| 5,654,039 | 8/1997 | Wenzel et al. | 427/391 |

FOREIGN PATENT DOCUMENTS

| | | | |
|---|---|---|---|
| 1122848 | 8/1968 | United Kingdom | B44D 1/00 |

*Primary Examiner*—Daniel Zirker
*Attorney, Agent, or Firm*—Myers Bigel Sibley & Sajovec

[57] ABSTRACT

The present invention provides a repulpable moisture vapor barrier. The moisture vapor barrier comprises a resin latex and a hydrophobic component having a crystalline platelet structure. Suitable resin latexes include polystyrene, styrene-acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof. Preferably the hydrophobic component is suspended in means for suspending the component such as fully hydrolyzed polyvinyl alcohol.

18 Claims, No Drawings

REPULPABLE MOISTURE VAPOR BARRIER

FIELD AND BACKGROUND OF THE INVENTION

The present invention relates to a moisture vapor barrier, and more particularly a moisture vapor barrier for paper and paperboard.

Fibrous substrates such as paper are widely used in packaging operations. Such fibrous substrates can be in sheet and roll form, and can be paper, paperboard, preformed paper containers, fabric and other fiber-based materials. Typically, fibrous substrates are subject to poor resistance to water vapor, gases, oil, solvents and greases. To improve the water vapor barrier resistance the fibrous substrates have been coated with a wide variety of compositions particularly when the substrates are used for food packaging.

Various coatings of this type are described in U.S. Pat. No. 3,632,424 to Graham et al. Of particular interest is the use of a wax or waxes incorporated into a latex and applied to a fibrous substrate as a coating. The physical phenomenon accounting for the good moisture vapor barrier properties of wax-coated paper is that the wax tends to migrate to the film surface to form a continuous wax layer. In laminating operations, however, this barrier layer can be interrupted; for example, such layers are susceptible to creases. Creases substantially reduce the water vapor resistance properties.

Additionally, the presence of wax makes recycling (repulping) of the fibrous substrate difficult. A conventional repulping operation typically comprises mixing water and the fibrous substrate, and the fibers are separated via mechanical action. The slurry may then be passed through screens and centrifugal cleaners to remove non-fibrous contaminants such as glass, metal, plastic, dirt, and other unwanted solid materials. In such repulping operations, the wax will separate and float to the surface of the repulping vessel. After waste paper is repulped, it is formed into paper or paperboard on the moving wire of a fourdrinier machine or on the cylinders of a cylinder machine, pressed and dried to remove the remaining water. If the separated wax is inadvertently incorporated into a paper sheet, the wax will appear as a grease spot, and coating and printing can be adversely affected.

It is therefore an object of the invention to provide a fibrous substrate having the moisture vapor layer applied thereto which maintains vapor resistance properties even if the fibrous substrate is creased.

Still another object of the present invention is to provide a moisture vapor barrier which obviates the problem associated with wax during repulping operations.

Another object of the invention is to provide a fibrous substrate having the moisture vapor layer applied thereto that can be printed, coated and bonded (e.g., using adhesive or glue) to another similar or dissimilar substrate.

SUMMARY OF THE INVENTION

The foregoing and other objects and advantages of the present invention are accomplished by a repulpable moisture vapor barrier comprising a resin latex and a hydrophobic component having a crystalline platelet structure, e.g., mica, clay, talc, kaolin, silica or the like modified to have hydrophobic properties. Suitable resin latexes include polystyrene, styrene-acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof. Preferably the hydrophobic component is suspended in means for suspending such as fully hydrolyzed polyvinyl alcohol.

The moisture vapor barrier composition of the present invention is applied to a variety of fibrous substrates, and particularly paper. The term "paper" includes paper of all weights and types, paperboard including Fourdrinier cylinders or other types, coated paper, printed paper and the like. The resulting fibrous substrate has excellent moisture vapor properties. Additionally, the fibrous substrate can be repulped without the problems associated with wax coatings during repulping process.

DETAILED DESCRIPTION OF THE INVENTION

As stated above, the repulpable moisture vapor barrier composition of the present invention is suitable for use with various fibrous substrates, and particularly paper. The moisture vapor barrier comprises a resin latex and a hydrophobic component having a crystalline platelet structure. Preferably the hydrophobic component is suspended in some means for suspending such as, for example, polyvinyl alcohol, and preferable fully hydrolyzed polyvinyl alcohol. Although the Applicants do not wish to be bound by one theory, Applicants believe that the crystalline platelet structure is aligned in the barrier resulting in a tortuous path for any moisture to go through the barrier. This results in the barrier properties being a bulk property rather than a surface property such as is present in wax-coated paper or in the use of wax dispersion in a latex. Moreover, such a structure is less susceptible to interruption of the barrier such as caused by creasing or lamination to another layer. Additionally, it is believed that the component having a crystalline platelet structure has a high aspect ratio and the hydrophobic modification thereof, the mica can be fully dispersed on recycling. The means for suspending, i.e., the fully hydrolyzed polyvinyl alcohol, in addition to facilitating the application of the coating does not adversely affect the water resistant properties of the barrier. It is believed that this is due to its hydrophobic nature in contrast to the use of polyethylene oxide or other non-hydrophobic surfactants which are often used as dispersants.

Suitable resin latexes include polystyrene, styrene-acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof. The resin latex typically comprises from about 60 to 80 percent by weight, preferably about 60 to 75 percent by weight of the barrier composition although conventionally formulations are based on 100 parts of resin. The resin may also include additional comonomers such as monocarboxylic acid monomers, dicarboxylic acid monomers, unsaturated monocarboxylic ester monomers (e.g., acrylates and methacrylates), acrylamide-based monomers, half esters of unsaturated dicarboxylic acid monomers including mono esters of maleic acid or fumaric acid (e.g., monomethyl maleate), and blends and mixtures thereof. A particularly suitable resin is a styrene butadiene blend having a small amount of monomethyl maleate.

Suitable components having a crystalline platelet structure are mica, talc, silica, clay, and kaolin. These components are modified to provide hydrophobicity thereto. For example, mica is a preferred component and can be treated with calcium stearate to provide hydrophobicity. Typically, the calcium stearate is added at a 1 to 4 percent by weight level onto a 5 $\mu$m particle size mica. The mica employed in the present invention may be a natural mica such as muscovite, paragonite, phlogopite, biotite, and syrian mica, or a synthetic mica such as fluorine-contained phlogopite, fluorine/silicone-contained mica, and taeniolite. A particularly preferred mica is Kalsitex® available from Engelhard of Hartwell, Ga. The resin comprises from about 20 to 85 parts of the mica, preferably 30 to 45 parts based on 100 parts of resin. Additionally, the component preferably has a particle size of less than 100 $\mu$m.

The means for suspending the hydrophobic component is used at an amount of 0.5 to 3 parts by weight, preferably 1 to 2 parts by weight based on 100 parts of resin. The means for suspending must be capable of suspending the hydrophobic component while not adversely affecting the moisture barrier properties of the overall barrier composition. A particularly suitable means for suspending is a fully hydrolyzed polyvinyl alcohol such as PVOH 103 or PVOH 325 available from Air Products, Allentown, Pa.

The barrier composition may also include a number of other components such as biocides, defoamers, pigments, thickeners, crosslinking agents, flame retardants, catalysts, dispersing agents, wetting agents, and the like.

The following examples illustrate specific embodiments of the present invention. In the examples and throughout the specification, all parts and percentages are by weight, unless otherwise indicated

EXAMPLES

Example 1

A resin comprising 64.5 parts styrene, 33.5 parts butadiene, 0.75 parts monomethyl maleate and 0.75 parts acrylamide is formed using conventional techniques. The barrier composition comprises the following:

| Component | % Solids | Dry Weight % |
|---|---|---|
| Resin | 51.3 | 100 |
| Calcium stearate treated mica[1] | 100 | 35 |
| Polyvinyl alcohol[2] | 20 | 2 |
| Biocide[3] | 20 | 0.02 |
| Defoamer[4] | 100 | 0.1 |

The resulting barrier when applied to Kraft paper has excellent moisture vapor transmission rate (MVTR) properties.

[1]Kalsitex ® available from Engelhard, Hartwell, Georgia; 1.5 weight % calcium stearate on 30 $\mu$m particle size mica.

[2]A-103 available from Air Products, Allentown, Pennsylvania

[3]Proxel ® GXL available from ICI Americas, Inc., Wilmington, Delaware

[4]Drewplus ® L-191 available from Drew Industrial Division, Boonton, New Jersey

Example 2

In order to compare the moisture vapor barrier properties and the improvement thereof by practice of the present invention, several compositions were formulated using polyvinyl alcohol as the suspending means. As a comparison several compositions were prepared using polyethylene oxide as the suspending means. The barrier composition was then applied to Stone brown unbleached kraft paper and Cascade 16 rod and 10 rod brown unbleached kraft paper. The results are shown in Table 1. The 6 hour and 18 hour MVTR (Moisture Vapor Transfer Rate) were measured using Tappi Test Method T-464. The water absorptiveness of the paper was measured using Tappi Test Method T-441 and is often referred to as the "Cobb Test".

TABLE 1

| | Stone kraft | | | Cascade kraft 16 rod | | | Cascade kraft 10 rod | | |
|---|---|---|---|---|---|---|---|---|---|
| Parts Resin | 65 | 63 | 64 | 65 | 63 | 65 | 65 | 63 | 65 |
| Parts Mica | 35 | 35 | 35 | 35 | 35 | 35 | 35 | 35 | 35 |
| Parts PVOH 103 | | 2 | | | 2 | | | 2 | |
| Parts PVOH 325 | | | 1 | | | | | | |
| Parts Polyethylene Oxide | | | | | | 0.3 | | | 0.3 |
| Solids | 47.8 | 47.9 | 50.7 | | 47.9 | 47.1 | 48.0 | 47.9 | 47.1 |
| Coat Weight | 13.0 | 13.4 | 12.8 | 1 | 11.4 | 13.2 | 10.3 | 8.7 | 10.2 |
| 6 hr MVTR Avg. | 2.8 | 2.6 | 2.8 | | 3.4 | 3.1 | 4.6 | 3.3 | 4.1 |
| 18 hr MVTR Avg. | 3.0 | 3.1 | 3.3 | 3.2 | 3.7 | 3.4 | 4.8 | 3.6 | 4.4 |
| 10 min Cobb | 3.4 | 3.8 | 3.7 | 2.6 | 4.6 | 19.9 | 2.6 | 4.7 | 18.6 |

Table 1 illustrates that polyvinyl alcohol while facilitating the suspension of the mica, does not adversely affect the moisture barrier properties. Conversely, the use of a known surfactant/dispersant such as polyethylene oxide will adversely affect such barrier properties.

In order to demonstrate the amount of mica preferred, various levels of the mica are used from 25 parts to 45 parts with and without polyvinyl alcohol. Also, no mica and no resin are used to provide comparison.

TABLE 2

| parts Resin | parts Mica | parts PVOH 103 | parts PVOH 325 | 6 hr MVTR Avg. | 24 hr MVTR Avg. | Total Solids |
|---|---|---|---|---|---|---|
| 75 | 25 | | | 3.5 | 3.6 | 47.5 |
| 73 | 25 | 2 | | 4.4 | 4.4 | 48.0 |
| 74 | 25 | | 1 | 4.7 | 4.5 | 50.8 |
| 65 | 35 | | | 2.8 | 2.9 | 47.8 |
| 63 | 35 | 2 | | 2.6 | 3.0 | 47.9 |
| 64 | 35 | | 1 | 2.8 | 3.1 | 50.7 |
| 55 | 45 | | | 6.3 | 6.2 | 48.4 |
| 53 | 45 | 2 | | 2.3 | 2.8 | 47.9 |
| 54 | 45 | | 1 | 3.1 | 3.7 | 50.4 |
| 100 | | | | 10.1 | 9.8 | 47.5 |
| Stone base | | | | 105.1 | 94.1 | N/A |
| Cascade base | | | | 110.9 | 104.9 | N/A |

As can be seen in Table 2, optimally 25 to 35 parts by weight of the mica is used, wherein at higher levels there is a significant dropff of the MVTR values. Moreover, resin alone provides poor results, and uncoated paper is even poorer.

Example 3

The resin of Example 1 was formulated and 100 parts of the resin was blended with 55, 45, 35 and 25 parts mica wherein the 10 $\mu$m particle size mica is treated with 3 percent by weight calcium stearate. The results are shown in Table 3.

While various embodiments have been disclosed and described herein, it will be appreciated that various changes and modifications can be made by those skilled in the art without departing from the true spirit and scope of the invention, as defined in the following claims.

TABLE 3

| Sample | 6 hr Avg. | 17 hr Avg. at 6 hr wt. | 23 hr Avg. at Start wt. |
|---|---|---|---|
| 55 parts mica | 1.9 | 2.2 | 2.1 |
| 45 mica | 1.7 | 2.0 | 1.9 |
| 35 mica | 2.2 | 2.8 | 2.6 |
| 25 mica | 2.1 | 2.7 | 2.5 |

MVTR = 100 F/90% RH

That which is claimed:

1. A repulpable moisture vapor barrier for paper and paperboard devoid of wax and consisting essentially of a resin latex and a hydrophobic component having a crystalline platelet structure.

2. The repulpable moisture vapor barrier of claim 1 wherein the hydrophobic component is selected from the group consisting of mica, talc, silica, clay and kaolin.

3. The repulpable moisture vapor barrier according to claim 1 wherein the resin latex is selected from the group consisting of latexes of polystyrene, styrene-acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof.

4. The repulpable moisture vapor barrier according to claim 1 wherein the resin latex includes a comonomer selected from the group consisting of monocarboxylic acid monomer, dicarboxylic acid monomers, unsaturated monocarboxylic ester monomers, acrylamide-based monomers, half esters of unsaturated dicarboxylic acid monomers, and blends and mixtures thereof.

5. A fibrous substrate coated with the repulpable moisture vapor barrier of claim 1.

6. A repulpable moisture vapor barrier for paper and paperboard devoid of wax and consisting essentially of a resin latex selected from acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof, and 20 to 80 parts by weight based on 100 parts of resin latex of a hydrophobic component having a crystalline platelet structure.

7. The repulpable moisture vapor barrier of claim 6 wherein the hydrophobic component is selected from the group consisting of mica, tale, silica, clay and kaolin.

8. The repulpable moisture vapor barrier according to claim 7 wherein the hydrophobic component is calcium stearate treated mica.

9. The repulpable moisture vapor barrier according to claim 8 wherein said calcium stearate treated mica includes 0.5 to 3.0 parts by weight of means for suspending said mica.

10. The repulpable moisture vapor barrier according to claim 9 wherein the means for suspending said mica is a fully hydrolyzed polyvinyl alcohol.

11. The repulpable moisture vapor barrier according to claim 6 wherein the resin latex includes a comonomer selected from the group consisting of monocarboxylic acid monomer, dicarboxylic acid monomers, unsaturated monocarboxylic ester monomers, acrylamide-based monomers, half esters of unsaturated dicarboxylic acid monomers, and blends and mixtures thereof.

12. A fibrous substrate coated with the repulpable moisture vapor barrier of claim 6.

13. A repulpable moisture vapor barrier for paper and paperboard devoid of wax and consisting essentially of a resin latex and a calcium stearate treated mica.

14. The repulpable moisture vapor barrier according to claim 13 wherein said calcium stearate treated mica is suspended in means for suspending said mica.

15. The repulpable moisture vapor barrier according to claim 14 wherein the means for suspending said mica is a fully hydrolyzed polyvinyl alcohol.

16. The repulpable moisture vapor barrier according to claim 13 wherein the resin latex is selected from the group consisting of latexes of polystyrene, styrene-acrylonitrile, styrene-acrylonitrile-butadiene, styrene acrylates, styrene-butadiene, carboxylated styrene butadiene, polyvinyl chloride, polyvinyl acetate, waterborne polyurethanes, alkyl acrylates, polyvinylidene chloride, ethyl vinyl chloride, and copolymers and terpolymers thereof.

17. The repulpable moisture vapor barrier according to claim 13 wherein the resin latex includes a co-monomer selected from the group consisting of monocarboxylic acid monomer, dicarboxylic acid monomers, unsaturated monocarboxylic ester monomers, acrylamide-based monomers, half esters of unsaturated dicarboxylic acid monomers, and blends and mixtures thereof.

18. A fibrous substrate coated with the repulpable moisture vapor barrier of claim 13.

* * * * *